United States Patent [19]

Snyder

[11] 4,286,418

[45] Sep. 1, 1981

[54] SPOUTING ICE PROTECTORS

[76] Inventor: Ralph C. Snyder, 32830 Arlesford Dr., Solon, Ohio 44139

[21] Appl. No.: 51,446

[22] Filed: Jun. 25, 1979

[51] Int. Cl.[3] ..... E04D 13/02; E04D 13/06

[52] U.S. Cl. ..... 52/11; 52/105; 292/64

[58] Field of Search ..... 52/11, 12, 15, 105; 49/465; 292/64, 67, 68

[56] References Cited

U.S. PATENT DOCUMENTS

| | | | |
|---|---|---|---|
| 189,431 | 4/1877 | Creighton | 52/11 |
| 233,677 | 10/1880 | Hess | 52/12 |
| 274,393 | 3/1883 | Schaffert | 52/12 |
| 836,012 | 11/1906 | Cassen | 52/12 |
| 846,238 | 3/1907 | O'Dowd | 52/11 |
| 1,243,119 | 10/1917 | Wicks | 52/12 |
| 2,284,440 | 5/1942 | Morrissey | 52/12 |
| 2,672,832 | 3/1954 | Goetz | 52/12 |
| 2,805,632 | 9/1957 | Couture | 52/12 |
| 2,849,764 | 9/1958 | Rich et al. | 49/465 X |
| 2,851,969 | 9/1958 | Teutsch | 52/12 |
| 3,929,360 | 12/1975 | Gulistan | 292/67 |

FOREIGN PATENT DOCUMENTS

| | | | |
|---|---|---|---|
| 15786 | of 1903 | United Kingdom | 49/465 |

OTHER PUBLICATIONS

American Roofer, p. 60, Feb. 1961.

*Primary Examiner*—Alfred C. Perham
*Attorney, Agent, or Firm*—Frederic B. Schramm

[57] ABSTRACT

A protector for roof spouting or eavestroughs is formed from lengths of dark, sun-heat-absorbing plastic, secured with one edge under the lowermost shingles of a roof and the other edge overhanging the lip of the spouting and secured thereto by fastener strips fitting under the spouting lip.

8 Claims, 6 Drawing Figures

SPOUTING ICE PROTECTORS

BACKGROUND OF THE INVENTION

It has long been a problem to prevent ice and snow from collecting in roof spouting or gutter and clogging the spouting or gutter and the drains under thawing and freezing conditions and various efforts have been made to alleviate the problem.

It has been proposed, for example, to provide eaves trough covers as described in Goetz U.S. Pat. No. 2,672,832, which require supporting spikes to be driven into the building wall below the eaves to carry tubular members, to which discs are soldered for mounting the eaves trough covers. Consequently, the supporting assembly cannot readily be removed in the spring.

A shield partially covering the spouting has also been proposed as in Cassen U.S. Pat. No. 836,012. In this case, however, the installation is permanent, requiring braces nailed to the shingles and to the wall and riveted to the shield. An effort to overcome the disadvantages of a permanent installation which would prevent the eaves trough from functioning normally is represented by a proposal to provide a hinged or pivoted tin cover as described in Schaffert U.S. Pat. No. 274,393 of 1883. In this case, however, it is impracticable to uncover the trough except when opened for cleaning. Thus the problem has existed nearly a century.

Roof gutter screens for keeping out leaves and such debris have also been proposed as in Couture U.S. Pat. No. 2,805,632 and Steel U.S. Pat. No. 2,734,467. The former involves the use of riveted clips joining the screen to the gutter and rather complicated clamping means, not readily disassembled.

SUMMARY OF THE INVENTION

In carrying out the invention in a preferred form thereof, snow and ice are prevented from collecting in roof spouting or gutter and clogging the outlets, as well as building up excessive weight, which may result in collapse or sagging of the roof gutter. This is accomplished by provision of improved protector strips arranged in alignment and provided with improved means for mounting and securing the protector strips in position covering the roof gutter and closing it from accumulation of ice and snow.

In a preferred embodiment of the invention, the protector strips are comprised of plastic sheeting for lightness and an opaque or dark plastic is used to absorb the sun's rays to absorb heat. Resultant, slight warming of snow as it falls promotes melting and tends to eliminate ice and snow. Roof gutter or spouting, as usually made, includes a lip which is utilized for engagement of fastening means fitting thereunder and secured to the protector strip to act as securing clamps. The plastic protector strips are mounted to conform to the roof edge with the upper edge of the protector strip fitting under the lowermost row of shingles.

DRAWINGS

A better understanding of the invention will be obtained from the following description considered in conjunction with the drawings in which.

Like reference characters are utilized throughout the drawings to designate like parts.

DETAILED DESCRIPTION

Figure 1:
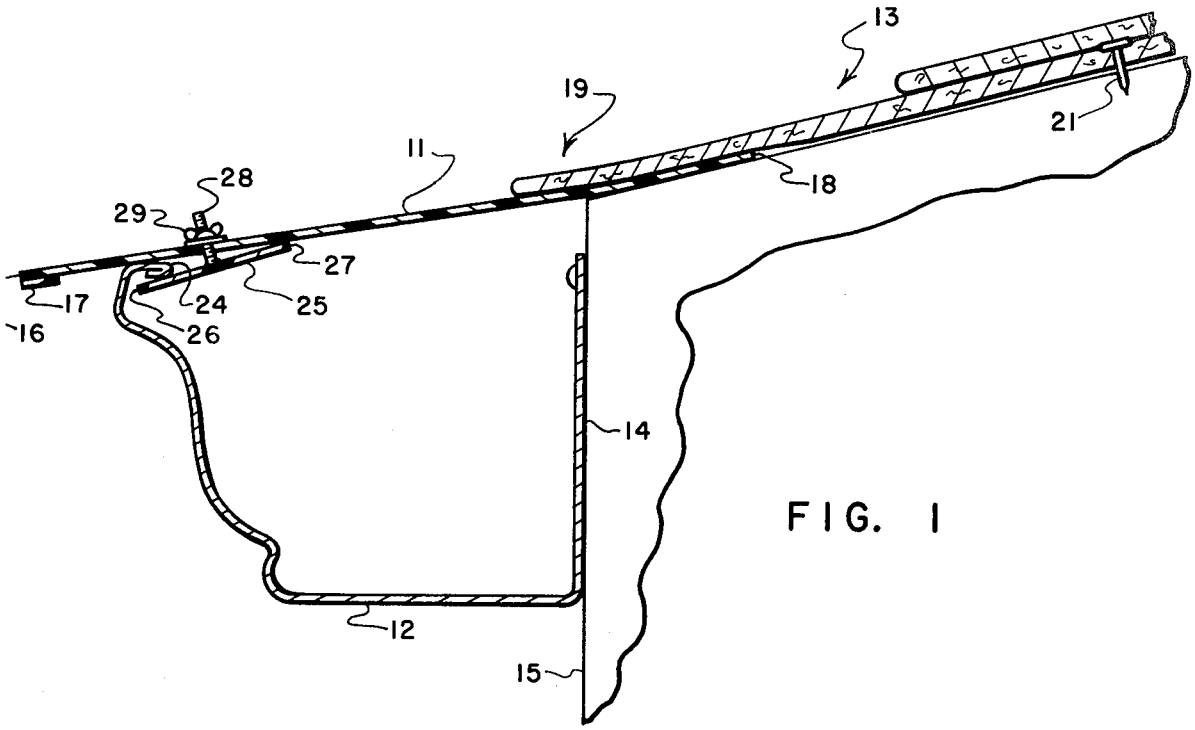
FIG. 1 is fragmentary schematic elevation of a shingle-roofed building showing in cross-section the lower portion of a sloping roof, the adjacent roof spouting or eavestrough, a protector mounted in place and securing means therefor.

In the embodiment of the invention illustrated in FIGS. 1 to 4 of the drawings, a protector strip 11, preferably composed of plastic sheeting, fiberglass or the like, is mounted in position to cover the entire open top of spouting or a roof gutter 12, which is secured to the wall 14 of a building 15. The protector strip 11 is secured to extend from under the lowermost row of shingles 19 and the building 15 to beyond the outside edge of the gutter 12 to form a snow shield. The lower edge 16 of the protector strip 11 may, if desired, be provided with reinforcement 17, but successful results have been obtained without such reinforcement.

In mounting the protector strip 11, its upper edge 18 is inserted under the lowermost row 19 in the shingles of the roof 13. It will be understood that in the usual roof construction only the upper ends of shingles are nailed down, for example, at the point 21.

Figure 2:
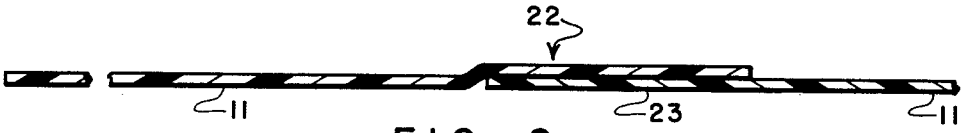
FIG. 2 is fragmentary side view of overlapping end-portions of adjacent aligned lengths of protector strip showing the manner of overlay.
Figure 3:
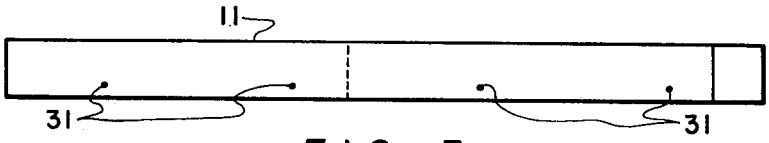
FIG. 3 is a plan view of one of the protector strips showing the spacing of securing posts.
Figure 4:
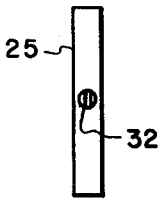
FIG. 4 is a plan view of a fastener strip for securing the protector strip.

The invention is not limited to the use of strips 11 of specified dimensions. However, for convenience in connection with spouting or roof gutter of conventional size, strips 11 may be used which are eight inches wide and four feet long and 1/16" to $\frac{1}{8}$" thick. The last strip in an aligned row may be sawed off to reach the edge of the roof. Preferably, successive strips 11 in a row are overlaid to eliminate any opening between successive strips and prevent entry of snow into the spouting or roof gutter 12. As shown in FIG. 2 the overlay is accomplished by forming the strips 11 with offset end portions 22 to lap the adjacent and portion 23 of the next strip 11.

Conventional spouting or roof gutter 12 as ordinarily supplied, is formed with a lip 24. This is utilized for securing the strips 11 and preventing them from sliding or from being lifted in the wind. Fastener strips 25 which may also be composed of plastic are provided, which fit at one end 26 under the lip 24 and bear at the other end 27 against the lower surface of the protector strip 11.

Each fastener strip 25 has non-rotatably secured thereto, a threaded post 28 adapted to receive a mating element such as a wing nut 29. Preferably the strip 25 and post 28 are formed integrally, composed of plastic. A series of holes 31 are punched in the protector strips 11 to receive the posts 28 of the fastener strips 25. Moreover, especially when the protector strips are made of opaque or black or dark plastic, the posts 28 are formed with screwdriver slots 32 in the upper ends thereof, which are aligned with the length of the fastener strip. In this manner, a screwdriver may be employed to turn the fastener strip to the proper position transverse to the spouting lip 24.

In addition, the direction of the slot 32 may be observed to provide an indication to the installer when the fastener strip 25 is in the proper angular position notwithstanding the fact that the fastener 25 may not be visible under an opaque protector strip 11.

The protector strips 11 may readily be installed before the advent of snow and freezing weather. The fastener strips 25 are first assembled with the protector strips 11 by passing the posts 28 through the holes 31 and loosely applying the wing nuts 29. Starting at one end of the roof a protector strip 11 is placed in position over the spouting or gutter 12 with the upper edge 18 under the lower row of shingles 19. Before securing the strip 11, the fastener 25 is turned, if necessary, to clear the lip 24, then turned to a position transverse to the lip 24 by means of a screwdriver acting in the slot 32. Thereupon the wing nut 29 may be tightened to draw up the fastener strip 25.

Figure 6:
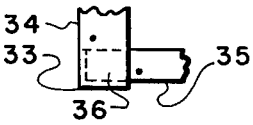
FIG. 6 is a fragmentary plan view of the overlapping ends of protector strips mounted in place at the corner of a hip roof.

The next strip 11 is positioned in a similar manner with the offset end 22 overlapping the flat end 23 of the previous protector strip already in place. If necessary, a remaining fraction of the last protector strip positioned at one side of the roof is sawed off to fit the roof. If a hip roof is involved having a corner 33 as illustrated in FIG. 6, a protector strip 34 is merely positioned in the manner previously described, transverse to an end strip 35 and with an offset end 36 overlaying the end of the strip 35.

Figure 5:
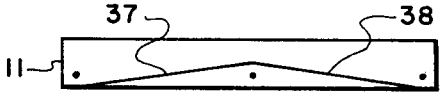
FIG. 5 is a plan view of a modified protector strip having rainwater deflecting means for use above doorways.

If it is desired to prevent rainwater and melting snow from dripping down over a doorway or entrance stoop, this is accomplished by the positioning on the eaves over the doorway of a special protector strip such as illustrated in FIG. 5. In this case the strip 11 has deflector strips 37 and 38 formed on the strip 11 or secured thereto transverse to the plane of the strip 11. The deflectors 37 and 38 meet at an obtuse angle, as shown, and slope downwardly.

While the invention has been described as embodiment in concrete form and as operating in a specific manner in accordance with the provisions of the patent statutes, it should be understood that the invention is not limited thereto since various modifications thereof will occur to those skilled in the art without departing from the spirit of the invention.

What is claimed as new and desired to be secured by Letters Patent of the United States is:

1. A roof-spouting ice protector comprising in combination:

a plastic protector strip having a plurability of openings therein, longitudinally spaced, a fastener comprising a strip relatively narrow and short in comparison with the said plastic strip, and having a threaded post perpendicularly secured thereto intermediate the length thereof, and adapted to be passed through holes in said plastic strip from below, a nut mating the thread of said post adapted to draw said fastener toward said plastic strip for securing the latter against and over spouting.

2. A device as described in claim 1, wherein the plastic strip is opaque and dark in color to absorb sun rays for warming and promoting melting of snow falling thereon and the threaded post has an upper end formed with a screwdriver slot aligned with said fastener strip for indicating the angular position of said fastener strip to enable the fastener strip to be angularly positioned before tightening said nut.

3. An ice protector shield for protecting a substantially horizontal roof gutter against ice accumulation, said gutter being of predetermined width mounted under the eaves of a roof and having a substantially horizontally extending lip, said shield comprising in combination a protector strip formed with longitudinally spaced holes and fasteners, each relatively narrow and short in comparison with the protector strip and having a post perpendicularly secured thereto intermediate the length thereof adapted to be passed through one of said holes from below, and means for drawing said post upward with one end of the fasteners under the lip of the gutter.

4. An ice protector as in claim 3 wherein the posts are threaded, and the means for drawing the posts upward comprise mating wing nuts.

5. An ice protector as in claim 3 wherein the protector strip is comprised of dark, opaque plastic for absorption of sun's rays, warming and promoting melting of snow falling thereon and the posts have upper ends formed with screwdriver slots aligned with said fastener strips for indicating the angular position of the fastener strip to enable an observer from above said opaque plastic to position the fastener strip angularly with an end under the gutter lip before the fastener strip post is drawn upward.

6. A shield for protecting a substantially horizontal roof gutter against ice accumulation, said gutter being of predetermined width mounted under the eaves of a roof and having a substantially horizontally extending lip, said shield, comprising in combination a protector strip formed with longitudinally spaced holes and one-piece fasteners, each having a portion relatively narrow and short in comparison with the protector strip and having an integral post perpendicular to the narrow portion, intermediate the length thereof, adapted to be passed through one of said holes from below with one end of the fastener against the protector strip and the other end of the fastener under the lip of the gutter.

7. A roof-gutter ice protector comprising in combination:

a plastic protector strip having a plurality of openings thereon, longitudinally spaced, a fastener comprising a portion relatively narrow and short in comparison with the said plastic strip, and having a post perpendicularly secured to the narrow portion of the fastener intermediate the length thereof, and adapted to be passed through holes in said plastic strip from below, and means for drawing said fastener toward said plastic strip for securing the gutter against and over a roof gutter.

8. A device as described in claim 7, wherein the post has an upper end formed with means aligned with said fastener for indicating the angular position of said fastener to enable the fastener to be angularly positioned before securing it.

* * * * *